US005257483A

United States Patent [19]

Netek

[11] Patent Number: 5,257,483

[45] Date of Patent: Nov. 2, 1993

[54] REINFORCING TIE BETWEEN ROOF RAFTER AND BUILDING

[76] Inventor: Bruce H. Netek, 2549 Crestlea Dr., Corpus Christi, Tex. 78415

[21] Appl. No.: 973,279

[22] Filed: Nov. 9, 1992

[51] Int. Cl.[5] ..... E04B 1/38

[52] U.S. Cl. ..... 52/23; 52/92.2; 52/93.2; 52/696; 52/712; 52/167 R

[58] Field of Search ..... 52/712, 715, 23, 693, 52/696, 317, 167 R, 167 CB, 92.2, 93.1, 93.2

[56] References Cited

U.S. PATENT DOCUMENTS

| | | | |
|---|---|---|---|
| Re. 34,022 | 8/1992 | Davis | 52/693 |
| 858,933 | 7/1907 | White | 52/715 |
| 1,375,420 | 4/1921 | Schumacher | 52/93.1 |
| 1,657,441 | 1/1928 | Hovnen | 52/92.2 X |
| 1,920,607 | 8/1933 | Summers | 52/712 |
| 2,141,888 | 12/1938 | Venzie | 52/712 |
| 2,467,115 | 4/1949 | Duggan | 52/92.2 X |
| 2,947,119 | 8/1960 | Puckett, Jr. | 52/92.2 X |
| 4,049,082 | 9/1977 | Reid | 52/693 X |
| 4,333,293 | 6/1982 | Jackson | 52/693 X |
| 4,565,037 | 1/1986 | DeSchane | 52/696 X |
| 4,570,403 | 2/1986 | Dannemiller | 52/712 X |
| 4,570,407 | 2/1986 | Palacio et al. | 52/712 X |
| 5,150,553 | 9/1992 | Commins et al. | 52/712 X |

*Primary Examiner*—Carl D. Friedman
*Assistant Examiner*—Robert Canfield
*Attorney, Agent, or Firm*—Turner Moller. Jr.

[57] ABSTRACT

A tie extends from the lower end of a roof rafter to the building and temporarily supports the roof rafter during times of expected high loads, such as during hurricanes. The tie is a metal strap having ends which are fastened respectively to the lower end of the roof rafter and to the building, either to a vertical wall or to the foundation.

8 Claims, 4 Drawing Sheets

REINFORCING TIE BETWEEN ROOF RAFTER AND BUILDING

BACKGROUND OF THE INVENTION

This invention relates in functionality but not in concept or design to existing sheet metal tie members for tying roof structures to wall structures for the purpose of preventing the roof structure from separating from the wall structure in the event the roof structure is subjected to the uplift component force created by extremely high winds such as those winds created by hurricanes, typhoons, tornados, etc.

Presently existing patents on sheet metal tie members for the purpose described above are designed to be installed during the construction of a building. Once construction is complete installation of these existing patents would be impractical. The existing patents were also designed to be fastened to the connection itself between the roof structure and the wall structure. The existing patents are also considered permanent once installed.

In contrast to the existing patents, this invention is designed to be installed after construction of a building is complete. Also, this invention, rather than being fastened to the connection itself is fastened to the outer edge of the roof structure at the upper end of the tie and to the exterior wall or foundation at the lower end of the tie. In other words instead of being an internal tying device, this invention is an external tying device. Also, in contrast to the existing patents, this invention is not considered a permanent device, but a temporary device to be installed when the threat of damaging conditions are prevalent and then removed once the threat has ended.

Said existing patents referred and compared to are:

Gilb, U.S. Pat. No. 4,572,695, 1984

Commins, U.S. Pat. No. 4,714,372, 1987

Commins, U.S. Pat. No. 4,932,173, 1990

SUMMARY OF THE INVENTION

This invention is a removable exterior reinforcing tie specifically designed for buildings having roofs with eaves or overhangs. The sole function of this invention is to reduce the upward component force that is introduced to the connections between the roof structure and the wall structure of a building when the roof structure is subjected to the upward lifting effect that is created by extremely high winds catching the underside of a roof's eave or overhang.

The primary object of this invention is to provide a device to tie the edge of a roof structure to the exterior wall or foundation of a building for the purpose of preventing the failure of the connections between the roof structure and the wall structure of a building in the event the connections are subjected to the stress described above.

Another object of this invention is to provide a device that will reduce the upward component stress introduced to the connections between the roof structure and the exterior wall structure thereby reducing the potential for connection failure.

Another object of this invention is to provide a device, for the purpose of tying a roof structure to its building, that can be installed after construction of the building is complete.

Another object of this invention is to provide a device, for the purpose of tying a roof structure to its building, that can be installed anytime prior to a hurricane assault and then removed once the threat has ended.

Another object of this invention is to provide a device that affords a person the means to provide added protection, for their building's roof, that was not previously available prior to this invention.

Another object of this invention is to provide a device that is easy to install and remove by both skilled and unskilled persons.

Another object of this invention is to provide a device, for the purpose of reinforcing one's roof structure in the event of a hurricane, that is effective yet relatively inexpensive.

DETAILED DESCRIPTION OF THE INVENTION

This invention, is an exterior tie member that is manufactured from 16 gauge galvanized sheet metal. The sheet metal is cut to a specified size, thereby creating a single sheet metal member of which this invention is constructed.

Figure 2:
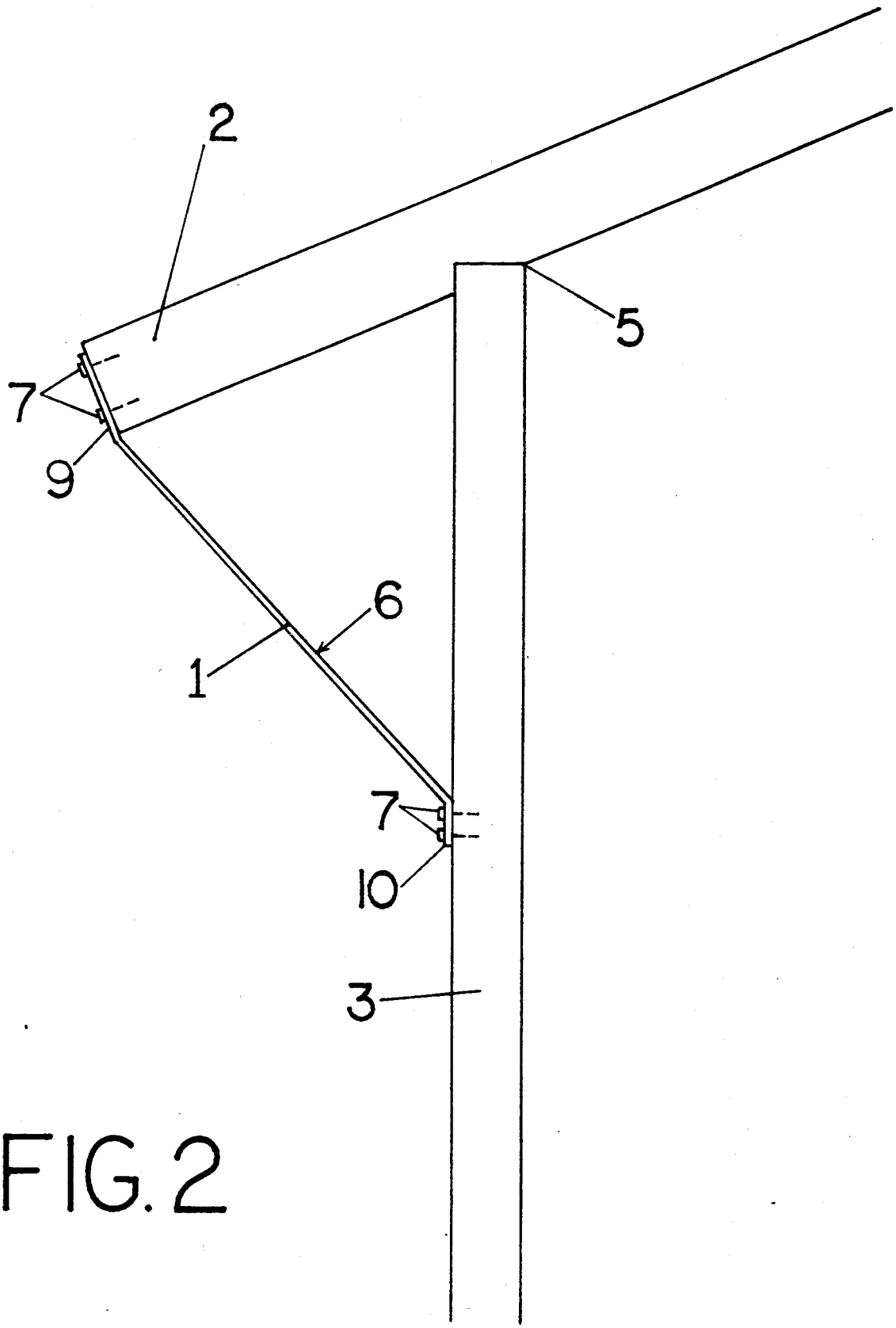
FIG. 2 is a cross section of a typical exterior wall structure of a building in which this invention is intended. The view shows the intended fastening points for this invention onto a building's roof rafter and the exterior wall structure.
Figure 3:
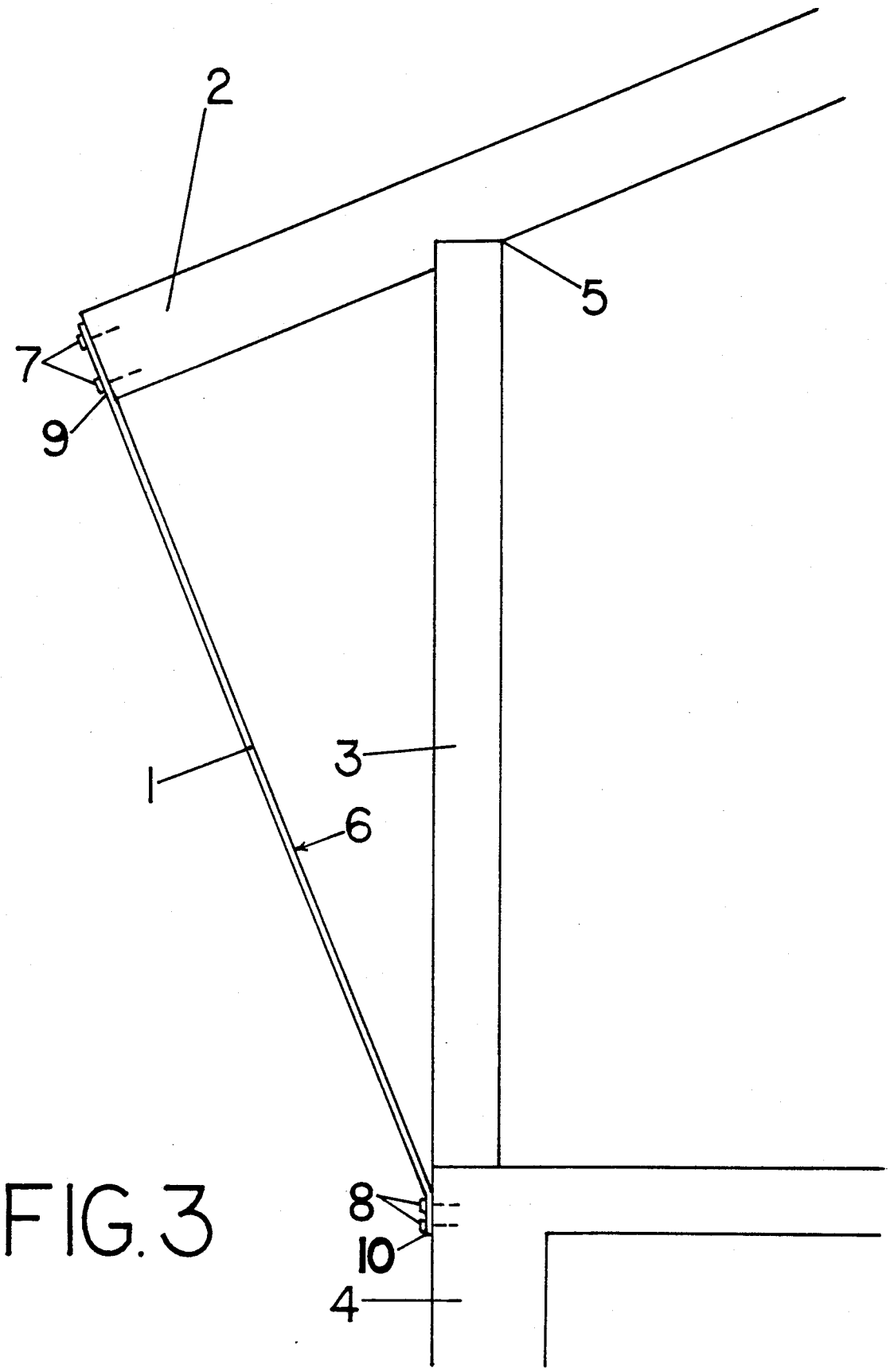
FIG. 3 is also a cross section of a building as described in FIG. 2. The view shows the intended fastening points for this invention onto a building's roof rafter and the exterior side surface of the foundation.

Referring to FIGS. 2 and 3, the tie member 1, being the present invention, is designed to be fastened to a building at two points. The upper end 9 of the tie member 1 will fasten to the end of the roof rafter 2 comprising one fastening point. The lower end 10 of the tie member 1 will fasten to either the exterior wall stud 3 at any point below that of which would place the inside surface 6 of the mid section 11 of the tie member 1 at a 60 degree angle in relation to the vertical wall stud 3 or to the foundation 4, thereby comprising the second fastening point.

By fastening the tie member 1 to a building as described above, the intensity of the upward component force that would otherwise be introduced to the connection 5 as a result of extremely high winds "catching" the underside of the portion of the roof rafter 2 extending outward beyond the connection 5 will be significantly reduced as the portion of the roof rafter 2 extending outward past the connection 5 is now tied down to the exterior wall stud 3 or to the foundation 4.

The upper end 9 of the tie member 1 will be bolted to the end of the roof rafter 2 by use of two $\frac{1}{4}'' \times 2''$ lag bolts 7. A 3/16" pilot hole should be drilled into the end of the roof rafter 2 at each bolt 7 position to prevent splitting of the wood member 2. The bolts 7 should be vertically centered at the end of the roof rafter 2 and horizontally spaced according to the size of the roof rafter 2.

Where there may be a facial board covering the end of the roof rafter 2, a longer bolt 7 will be necessary to fasten the upper end 9 of the tie member 1 to the end of the roof rafter 2. To determine the length of the bolt necessary the thickness of the facial board will first need to be established. Then by adding the thickness of the facial board to the 2" length of the bolt 7 recommended the necessary bolt 7 length will be established. Because of the possible variations in building methods, no drawings are hereby submitted as it is deemed obvious as to how the necessary bolt 7 lengths are established.

The lower end 10 of the tie member 1 may be bolted to the exterior wall stud 3 by use of two ¼"×2" lag bolts 7. A 3/16" pilot hole should be drilled into the wall stud 3 at each bolt 7 position to prevent splitting of the wood member 3. The bolts 7 should be vertically centered on the wall stud 3. Because exterior sheathing typically covers the exterior wall stud 3, a longer bolt 7 will be necessary to fasten the lower end 10 of the tie member 1 to the exterior wall stud 3. To determine the length of bolt 7 necessary the thickness of the exterior sheathing will first need to be established. Then by adding the thickness of the exterior sheathing to the 2" length of bolt 7 recommended the necessary bolt 7 length will be established. Because of the variations in building methods, no drawings are hereby submitted as it is deemed obvious as to how the necessary bolt 7 lengths are established.

Where there may be brick veneer covering the exterior wall stud 3, two ¼"×2" brick anchor bolts should be used to fasten the lower end 10 of the tie member 1 to the brick veneer. No drawings are hereby submitted as it is deemed obvious as to how to fasten the lower end 10 of the tie member 1 to a brick veneer.

The lower end 10 of the tie member 1 may also be fastened to the foundation wood members of a building being the wood floow joists and/or the wood sill beams. The bolting method for fastening the lower end 10 of the tie member 1 to a building's foundation wood members is as the bolting method for fastening the lower end 10 of the tie member 1 to the exterior wall stud 3 as described above. No drawings are hereby submitted as it is deemed obvious as to how to fasten the lower end 10 of the tie member 1 to a wood foundation member.

The lower end 10 of the tie member 1 may also be fastened to the concrete foundation 4 of a building. Two ¼"×2" concrete anchor bolts 8 will be necessary to achieve this fastening method.

Figure 4:
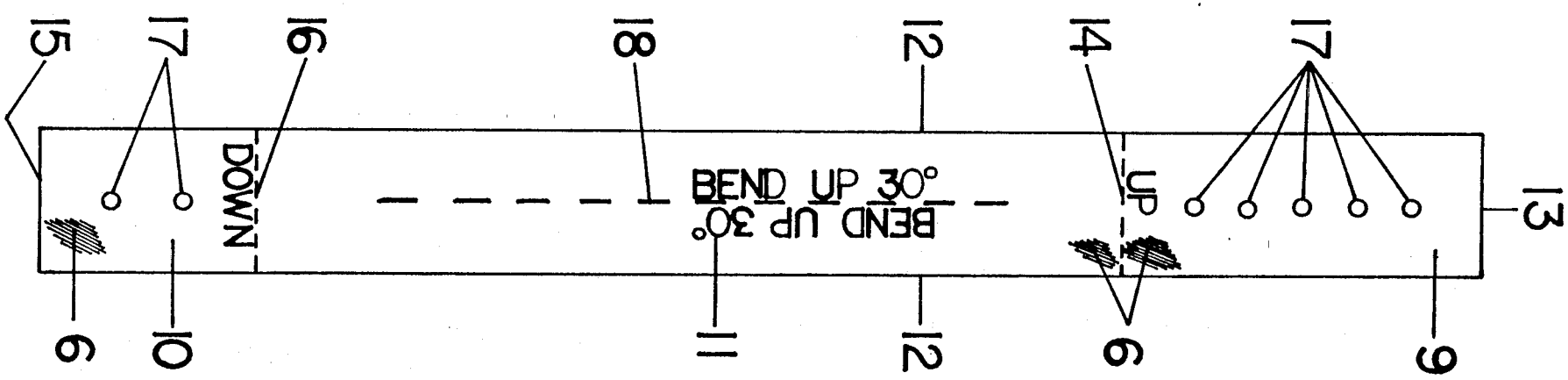
FIG. 4 is a plan view of this invention in blank form prior to bending along the bend lines.

Referring to FIG. 4, the tie member consists of a generally rectangular shape. The tie member in blank form prior to bending is shown with the inside surface 6 of the tie member in view. The tie member is divided into three sections as follows: the upper end 9; the lower end 10; and the mid section 11.

The upper end 9 is considered the rectangular area of the tie member defined by the boundaries of the two vertical sides 12, the horizontal upper edge 13, and the horizontal upper bend line 14.

The lower end 10 is considered the rectangular area of the tie member defined by the boundaries of the two vertical sides 12, the horizontal lower edge 15, and the horizontal lower bend line 16.

The mid section 11 is considered the rectangular area of the tie member defined by the boundaries of the two vertical sides 12, the horizontal upper bend line 14 and the horizontal lower bend line 16.

The measurement between the two vertical sides 12 is 1 ½". The measurement between the horizontal upper edge 13 and the horizontal upper bend line 14 is 5". The measurement between the horizontal lower edge 15 and the horizontal lower bend line 16 is 3". The measurement between the horizontal upper bend line 14 and the horizontal lower bend line 16 is determined by the desired fastening point of the lower end 10 of the tie member as determined by the consumer. In other words this measurement could be of a wide range anywhere from 12" to as much as 12' and more.

In the upper end 9 and the lower end 10 of the tie member there are ¼" holes punched for fastening the tie member to a building.

In the upper end 9 of the tie member there are five ¼" holes 17 centered vertically in the tie member and spaced ¾" apart measuring from horizontal center line to horizontal center line of each hole. The first hole down from the horizontal upper edge 13 measures 1" down from the upper edge 13 to the horizontal center line of the first hole down from the upper edge 13.

The purpose for having five holes 17 in the upper end 9 is to allow for fastening the upper end 9 of the tie member to various sizes of roof rafters. Because of the possible variations in building methods no drawings are hereby submitted as it is deemed obvious as to the various fastening possibilities of the upper end 9 to various size roof rafters.

In the lower end 10 of the tie member there are two ¼" holes 17 centered vertically in the tie member and spaced 1" apart measuring from horizontal center line to horizontal center line of each hole. The first hole down from the horizontal lower bend line 16 measures 1" down from the lower bend line 16 to the horizontal center line of the first hole down from the lower bend line 16. Both holes in the lower end 10 of the tie member will be utilized in fastening the lower end 10 of the tie member to a building using any bolting method described above.

The bend angle in the upper bend line 14 and the lower bend line 16 will vary depending on the pitch of the roof rafter 2 and the fastening point of the lower end 10 of the tie member as depicted in FIGS. 2 and 3. However, the direction of the bends will generally be as shown in FIG. 4.

In the mid section 11 a vertical bend line 18 extends from 2" down from the upper bend line 14 to 2" up from the lower bend line 16. The vertical bend line 18 is to provide the mid section 11 with rigidity for the purpose of handling of the tie member. Without this bend line 18 the tie member would be "limp" spanning the mid section 11 particularly when the vertical length of the mid section exceeds 16" in length.

Figure 1:
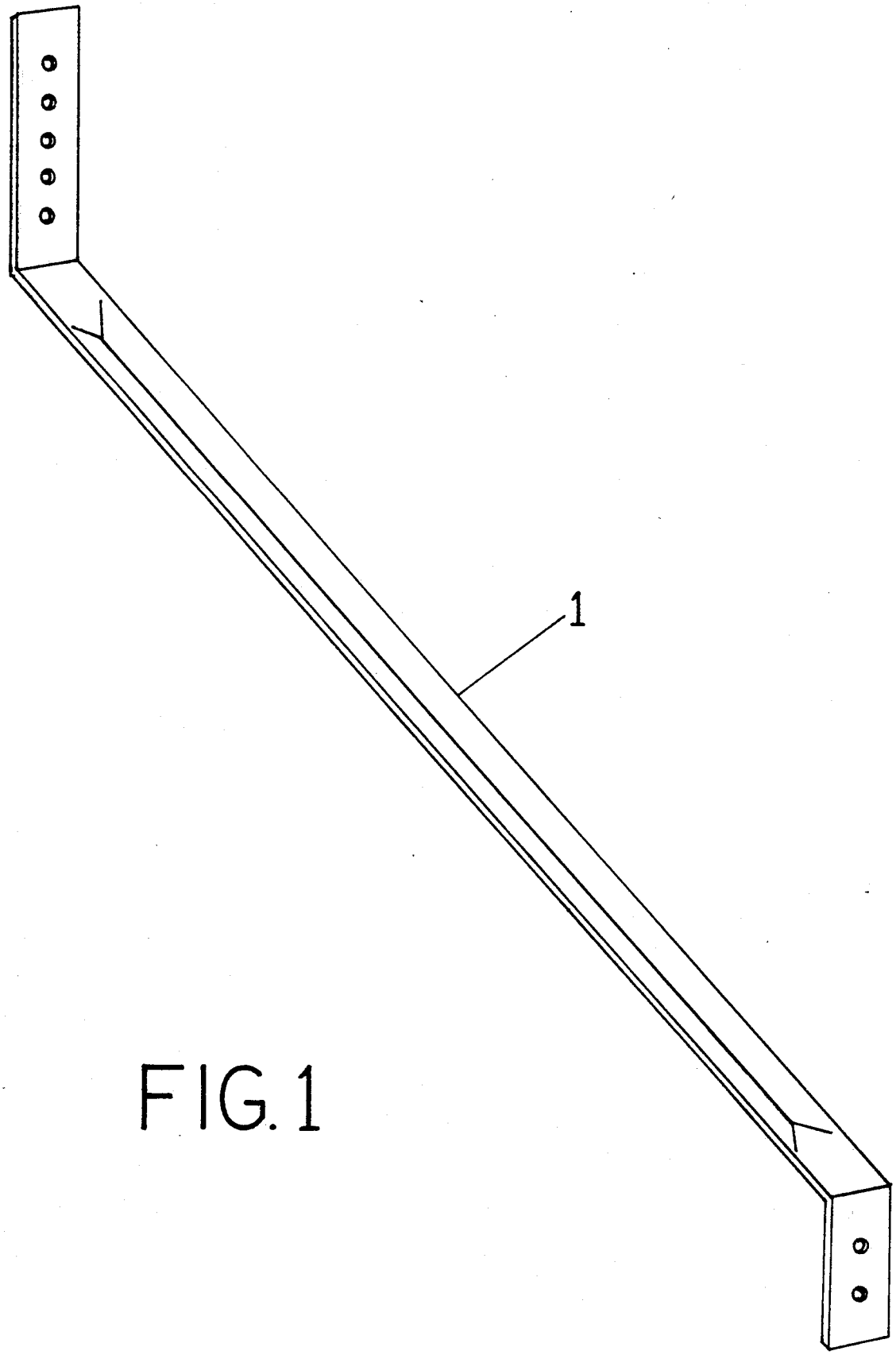
FIG. 1 is a perspective view of this invention after bending along the bend lines is completed.

The vertical bend line 18 will consist of a 30 degree upward bend on both sides of the bend line 18 as indicated in FIG. 4. This bending will result in a finish angle of 120 degrees. The angle of the bend will "taper" off at the 2" stopping point of the bend line 18 at both the upper bend line 14 and the lower bend line 16. This bending technique will result in a finish product form of the invention entitled The Netek Tie as depicted as the tie member 1 shown in FIG. 1.

I hereby claim:

1. A building including a roof comprising an inclined rafter having an outermost end and means supporting the roof above an underlying ground surface, the improvement comprising means reinforcing the rafter including a tie having a first end connected with the outermost rafter end and a second end connected to the supporting means, wherein the roof rafter comprises an elongate member and the outermost rafter end includes a face generally perpendicular to the elongate member, the tie being connected with the face of the outermost rafter end, and wherein the roof rafter overhangs the supporting means and the tie adjoins the supporting means at a point of connection, the tie and the supporting means defining an acute angle at the point of connection.

2. The building of claim 1 where in the supporting means comprises a foundation, the tie connecting the outermost rafter end to the foundation.

3. The building of claim 1 wherein the supporting means comprises an upstanding wall member, the tie connecting the outermost rafter end to the upstanding wall member.

4. The building of claim 1 wherein the building encloses a predetermined space and the tie resides outside the predetermined space.

5. The building of claim 1 wherein the tie comprises a metal strap.

6. The building of claim 1 wherein the tie comprises an elongate, generally straight middle section connecting the first and second tie ends.

7. The building of claim 6 wherein the middle section defines a plane and the first and second tie ends are at an angle relative to the plane.

8. The building of claim 7 wherein the middle section has been bent to provide first and second segments defining an obtuse angle therebetween.

* * * * *